US009528516B2

(12) United States Patent
Upton

(10) Patent No.: US 9,528,516 B2
(45) Date of Patent: Dec. 27, 2016

(54) COMPRESSOR HAVING OUTLET WITH GAP TO ENHANCE VOLUMETRIC EFFICIENCY

(75) Inventor: Jude Benedict Upton, Joondalup (AU)

(73) Assignee: Sprintex Australasia Pty Ltd, Malaga (AU)

( * ) Notice: Subject to any disclaimer, the term of this patent is extended or adjusted under 35 U.S.C. 154(b) by 227 days.

(21) Appl. No.: 13/260,608

(22) PCT Filed: Mar. 29, 2010

(86) PCT No.: PCT/AU2010/000359

§ 371 (c)(1),
(2), (4) Date: Dec. 13, 2011

(87) PCT Pub. No.: WO2010/108236

PCT Pub. Date: Sep. 30, 2010

(65) Prior Publication Data

US 2012/0093671 A1 Apr. 19, 2012

(30) Foreign Application Priority Data

Mar. 27, 2009 (AU) ..... 2009901326

(51) Int. Cl.
*F04C 18/16* (2006.01)
*F04C 18/20* (2006.01)
*F04C 29/12* (2006.01)

(52) U.S. Cl.
CPC ..... *F04C 18/16* (2013.01); *F04C 18/20* (2013.01); *F04C 29/12* (2013.01); *F04C 2240/30* (2013.01);
(Continued)

(58) Field of Classification Search
CPC ..... F01C 1/16; F01C 20/14; F01C 20/16
(Continued)

(56) References Cited

U.S. PATENT DOCUMENTS 2,480,818 A * 8/1949 Whitfield ..... 418/201.1
4,768,934 A 9/1988 Soeters, Jr.
(Continued)

FOREIGN PATENT DOCUMENTS

GB 636764 5/1950
GB 637942 5/1950
(Continued)

OTHER PUBLICATIONS

Australian Patent Office, International Preliminary Report on Patentability dated Jul. 30, 2010, PCT/AU2010/000359.

*Primary Examiner* — Nicholas J Weiss
*Assistant Examiner* — Paul Thiede
(74) *Attorney, Agent, or Firm* — Sunsteinn Kann Murphy & Timbers LLP

(57) ABSTRACT

A compressor (10) comprises counter rotating and intermeshing twisted rotors (18) and (20) disposed in a housing having an air intake plate (28) and an outlet (16). The outlet (16) has a first edge (60) and a second edge (70) which nm parallel with a length of the rotors (18) and (20) respectively. A gap (62) is formed in the outlet near a junction of the edges (60) and (70). Air which is compressed by the rotors (18) and (20) is able to bleed through the gap (62) in advance of trailing edges of lobes of at least one of the rotors (18) passing its corresponding edge (60). Also the rotors (18), (20) are arranged so that the trailing edge of a lobe of rotor (18) passes edge (60) before a trailing edge of a lobe of rotor (20) passes edge (70).

10 Claims, 9 Drawing Sheets

(52) U.S. Cl.
CPC .... *F04C 2250/102* (2013.01); *Y10T 29/49242* (2015.01)

(58) Field of Classification Search
USPC ..... 418/1, 197, 201.1, 196, 83, 206.4; 123/559.1
See application file for complete search history.

(56) References Cited

U.S. PATENT DOCUMENTS

| | | | | |
|---|---|---|---|---|
| 5,051,077 | A | 9/1991 | Yanagisawa et al. | |
| 5,056,995 | A | 10/1991 | Tamura et al. | |
| 5,118,268 | A | 6/1992 | Crisenbery et al. | 418/189 |
| 5,674,063 | A | 10/1997 | Ozaki et al. | |
| 6,585,503 | B2 | 7/2003 | Okada et al. | 418/201.1 |
| 6,769,890 | B2 | 8/2004 | Vigano et al. | |
| 6,821,098 | B2 | 11/2004 | Lifson | |
| 2007/0092393 | A1 | 4/2007 | Egan | |
| 2008/0175739 | A1* | 7/2008 | Prior | 418/83 |
| 2009/0148330 | A1* | 6/2009 | Swartzlander | 418/196 |
| 2009/0311119 | A1* | 12/2009 | Holden et al. | 418/1 |

FOREIGN PATENT DOCUMENTS

| | | | |
|---|---|---|---|
| JP | U-4-42286 | 9/1992 | F04C 18/16 |
| JP | 08-334029 | 12/1996 | F02B 33/36 |
| JP | 08334029 | 12/1996 | F02B 33/36 |
| JP | 2008-19821 | 1/2008 | F02B 33/36 |
| JP | 2008019821 | 1/2008 | F02B 33/36 |

* cited by examiner

COMPRESSOR HAVING OUTLET WITH GAP TO ENHANCE VOLUMETRIC EFFICIENCY

FIELD OF THE INVENTION

The present invention relates to a compressor, such as for example, a turbocharger, a supercharger and other forced induction devices.

BACKGROUND OF THE INVENTION

In the automotive industry compressors are commonly used to provide additional air mass flow to support combustion in combustion engines. The net effect of such compressors is to increase the power output of the engine for at least a range of engine rpm. The efficiency of such compressors is dependent on numerous factors including pressure ratio, volumetric efficiency and delta temperature.

The most common types of compressor are the turbocharger and the supercharger. A turbocharger usually comprises a fan driven by exhaust gases of the engine and coupled via a shaft to a rotor in the form of a turbine which forces air into an intake manifold of the engine. A supercharger differs from a turbocharger in that it is mechanically driven by the engine and usually comprises two intermeshing rotors or screws which transport air from an intake to an outlet port from where the air is subsequently delivered to an intake manifold.

SUMMARY OF THE INVENTION

One aspect of the invention provides a compressor comprising:

a housing provided with an inlet and an outlet;

a first rotor provided with a plurality of twisted lobes or blades, each lobe having a leading edge and a trailing edge, the first rotor capable upon rotation of transporting a fluid form the inlet to the outlet;

the outlet having a wall with: a first portion of the wall having an edge that is substantially parallel with a length of the lobe or blade; and a gap, the gap located in the wall at a position where the fluid being transported by the first rotor bleeds into the outlet through the gap before the trailing edge rotates past the edge.

The compressor may comprise a second rotor provided with a plurality of twisted lobes or blades, each lobe having a leading edge and a trailing edge, the lobes or blades of the second rotor intermeshing with the lobes or blades of the first rotor for a portion of a revolution of the first rotor, the first and second rotors co-operating to transport the fluid from the inlet to the outlet, and wherein the wall is provided with a second portion having an edge that is substantially parallel with a length of the lobe or blade of the second rotor, and wherein the gap is located so that the fluid bleeds into the outlet through the gap before the trailing edge of lobe or blade of the second rotor passes the edge of the second wall portion.

A second aspect of the invention may provide a compressor comprising:

a housing provided with an inlet and an outlet;

a first and a second rotor rotatable within the housing, each rotor provided with a plurality of twisted lobes, the lobes of the first and second rotors configured to intermesh for a portion of a revolution of the first rotor, the rotors when rotating capable of transporting a fluid form the inlet to the outlet;

the outlet having a wall with: a first portion of the wall having an edge that is substantially parallel with a length of the lobe of the first rotor;

a second portion of the wall having an edge that is substantially parallel with a length of the lobe of the second rotor; and, a gap positioned to bleed fluid being transported by the rotors into the outlet before the trailing edge of the lobes of the respective rotors rotates past the edge of the corresponding wall portions.

In both aspects the gap may project inwardly of the housing.

The housing may comprise two intersecting cavities, one of each housing a respective rotor, wherein a ridge is formed in the housing along line of intersection between the cavities, and wherein the gap is in substantial alignment with the ridge.

The gap may have a transverse width and the gap is disposed so that its width is laterally offset along the line of intersection.

The first and second rotors may be formed with different outer diameters.

The first and second rotors may be formed with a different number of lobes.

A third aspect of the invention provides a compressor comprising:

a housing provided with an inlet and an outlet;

a first and a second rotor rotatable within the housing, each rotor provided with a plurality of twisted lobes, the lobes configured wherein the lobes of the first and second rotors configured to intermesh for a portion of a revolution of the first rotor, the rotors when rotating capable of transporting a fluid form the inlet to the outlet;

the outlet having a wall with: a first portion of the wall having an edge that is substantially parallel with a length of the lobe of the first rotor; and, a second portion of the wall having an edge that is substantially parallel with a length of the lobe of the second rotor; the wall portions juxtaposed relative to their corresponding rotors wherein the trailing edge of a lobe of the first rotor passes the edge of the first wall portion before a trailing edge of an intermeshing lobe of the second rotates past the edge of the second wall portion.

A transverse distance between leading and trailing edges of a first lobe is different to a transverse distance between leading and trailing edges of the second lobe.

A fourth aspect of the invention provides a method of tuning a compressor having a housing provided with an inlet and an outlet and first and second rotors rotating in the housing and co-operating to transport a fluid from the inlet to the outlet, the method comprising: configuring the outlet relative to the rotors wherein a trailing edge of a lobe of the first rotor passes the outlet before a trailing edge of an intermeshing lobe of the second rotor.

Configuring the outlet relative to the rotors may comprise: forming the outlet with first and second wall portions where each wall portion has an edge configured to extend substantially parallel to a length of a corresponding lobe, and positioning the first and second wall portions so that the trailing edge of the first lobe passes the edge of the first wall before the trailing edge of the second intermeshing lobe passes the edge of the second wall portion.

A fifth aspect of the invention provides a compressor comprising:

a housing provided with an inlet and an outlet, the inlet being in communication with a fluid at a first pressure;

a rotor provided with a plurality of twisted lobes and rotatable in the housing, adjacent lobes defining respective channels there between, each channel having an inlet end adjacent the inlet and into which fluid from the inlet flows, the channel transporting the fluid toward the outlet as the rotor rotates;

wherein the inlet end of the channel closes for a portion of a revolution of the rotor after pressure of the fluid in the channel exceed the first pressure.

A sixth aspect of the invention provides a compressor comprising:

a housing provided with an inlet and an outlet the inlet being in communication with a fluid at a first pressure;

a rotor provided with a plurality of twisted lobes and rotatable in the housing, adjacent lobes defining respective channels there between, each channel having an inlet end adjacent the inlet and into which fluid from the inlet flows and shaped to carry a first volume of fluid at the first pressure, the channel transporting the fluid toward the outlet as the rotor rotates;

the compressor arranged to induce a flow of the fluid into the channel as the rotor rotates in a manner to charge the channel with a second volume of fluid that is greater than the first volume of fluid, the housing being configured to close the channel for a portion of a revolution of the rotor when the second volume of fluid in the channel is greater than the first volume of fluid.

A seventh aspect of the invention provides a compressor comprising:

a housing provided with an inlet and an outlet, the inlet comprising an open portion and a closed portion:

a first and a second rotor rotatable within the housing, each rotor provided with a plurality of twisted lobes, adjacent lobes of the first rotor defining respective channels there between, each channel having an inlet end adjacent the inlet and respective lobes of the second rotor projecting into respective channels for a portion of a revolution of the first rotor, the rotors when rotating co-operating to draw fluid form the inlet into the channels wherein at a point in a revolution of the first rotor pressure of fluid in a channel exceeds the first pressure; and, wherein the first rotor and, the inlet are relatively configured so that for a portion of a revolution of the rotor after the point the inlet end of the channel is located behind the closed portion of the inlet and substantially isolated from the fluid at the inlet.

An eight aspect of the invention provides method of operating a compressor of a type comprising first and second rotors rotatable in a housing and which co-operate to transport fluid presented at a first pressure at an inlet of the housing to an outlet where each rotor is provided with a plurality of twisted lobes that intermesh for a portion of a revolution of the rotors, and adjacent lobes of each rotor define respective channels, the method comprising:

for each channel, sequentially charging the channels of at least one of the rotors with fluid from the inlet for a first portion of a revolution of the rotors, with a volume of fluid greater than a volumetric capacity of the channels for the fluid at the first pressure, and substantially sealing the channels form the inlet for a second contiguous portion of a revolution of the first rotor.

A ninth aspect of the invention provides a method of operating a compressor a type comprising first and second rotors rotatable in a housing and which co-operate to transport fluid presented at a first pressure at an inlet of the housing to an outlet where each rotor is provided with a plurality of twisted lobes that intermesh for a portion of a revolution of the rotors, and adjacent lobes of each rotor define respective channels, the method comprising:

opening the outlet for each of the rotors at different times.

The methods may also comprise closing the inlet for each rotor at different times.

The methods may further comprise rotating the rotors at different speeds.

The methods may further relieving pressure of the fluid transported by the rotors prior to opening of the outlet of at least one of the rotors.

BRIEF DESCRIPTION OF THE DRAWINGS

Embodiments of the present invention will now be described by way of example only with reference to the accompanying figures in which.

DETAILED DESCRIPTION OF PREFERRED EMBODIMENTS

Figure 1:
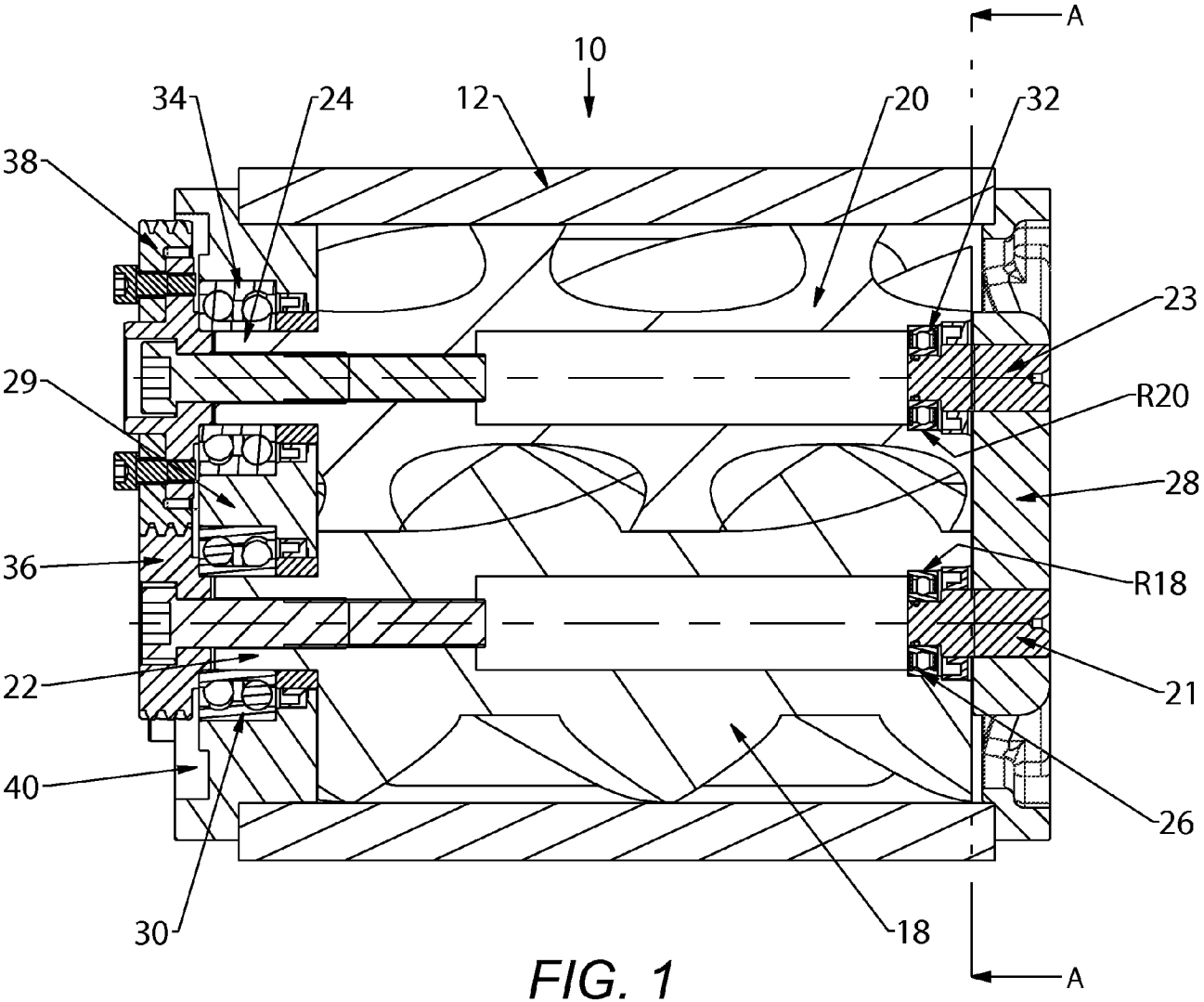
FIG. 1 is a plan view in partial section of an embodiment of a compressor in accordance with the present invention.

The accompanying figures depict an embodiment of a compressor 10 in the form of a supercharger. The compressor 10 comprises a housing 12 having an inlet 14 (see in particular FIG. 5), and an outlet 16 (see FIGS. 6-8). In the illustrated embodiment, the compressor 10 comprises two rotors in the form of a first or female rotor 18, and as second or male rotor 20. Rotors 18 and 20 are rotatably supported at their opposite ends via an intake plate 28 attached to one end of the housing 12 and an end plate 29 attached to an opposite end of the housing 12. More specifically an end of rotor 18 is provided with an axial recess R18 for receiving a stud 21 which in turn is supported by the intake plate 28. Bearing 26 is sealed in the recess R18 and on the stud 21. Spigot 22 extends axially from an opposite end of rotor 18. Bearing 30 is seated in the end plate 29 and on the spigot 22 to provide rotational support for this end of the rotor 18. Similarly an end of rotor 20 is provided with an axial recess R20 for receiving a stud 23 which is supported at an opposite end by the intake plate 28. Bearing 32 is seated in the recess R20 and on the stud 23. Spigot 24 extends axially from an opposite end of the rotor 20. Bearing 34 is seated in the end plate 29 and on the spigot 24 to provide rotational support for this end of rotor 20. Respective gears 36 and 38 are fixed to the spigots 22 and 24 adjacent the bearings 30 and 32 and reside within a recess 40 in end plate 29. A further coupling (not shown) is provided to impart torque to the spigot 24 which, by virtue of meshing gears 36 and 38, imparts torque to the spigot 22 effecting a rotation of the rotors 18 and 20 in opposite directions. Thus if the rotor 18 is rotated in an anti-clockwise direction, the rotor 20 rotates in a clockwise direction; and if the rotor 18 is rotated in a clockwise direction the rotor 20 rotates in an anticlockwise direction.

Figure 2:
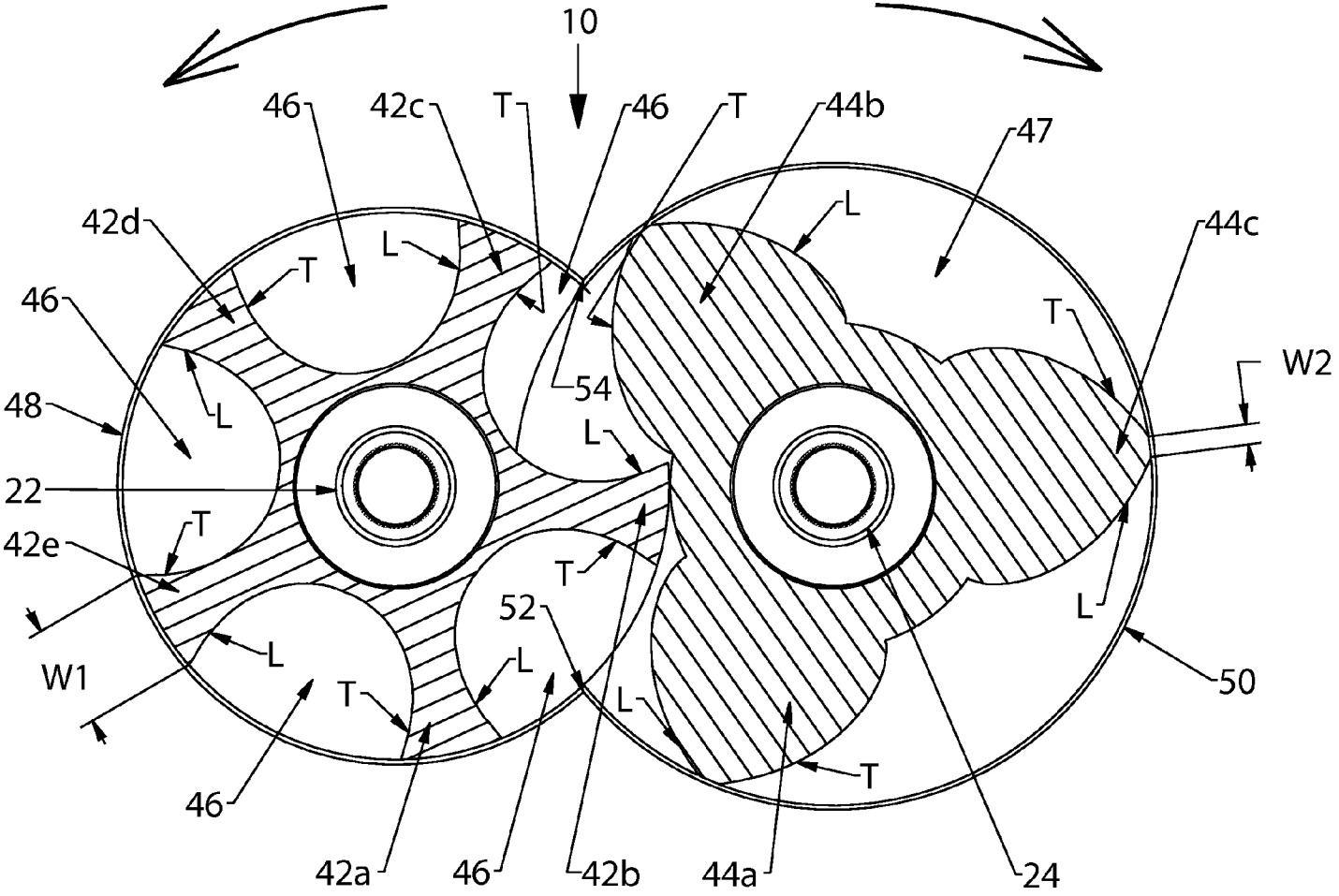
FIG. 2 is a view of section A-A of the compressor shown in FIG. 1.
Figure 3:
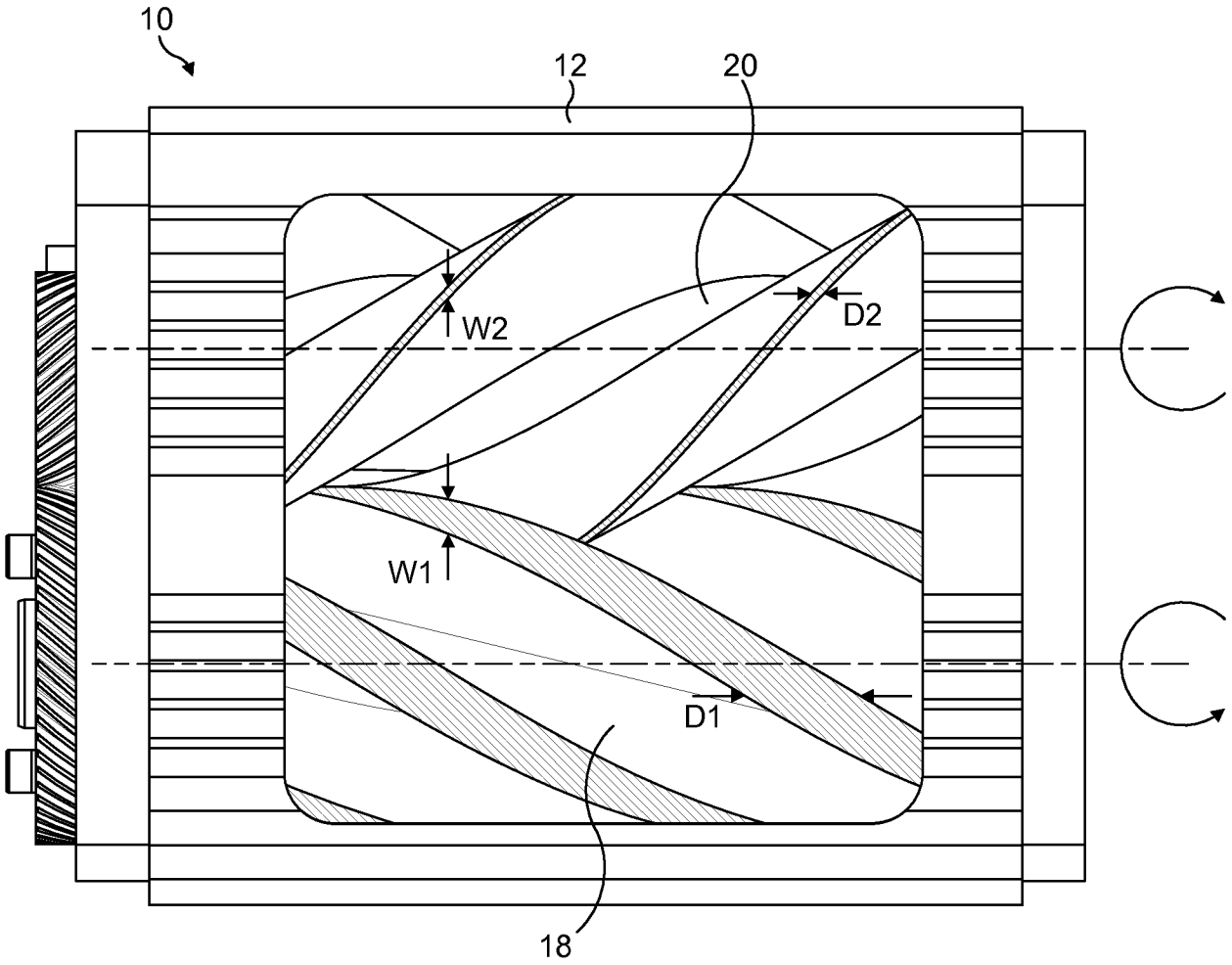
FIG. 3 is a plan view from the bottom of a compressor in accordance with the present invention in which rotors of the compressor are visible through a cut-out formed in a housing of a compressor.
Figure 4:
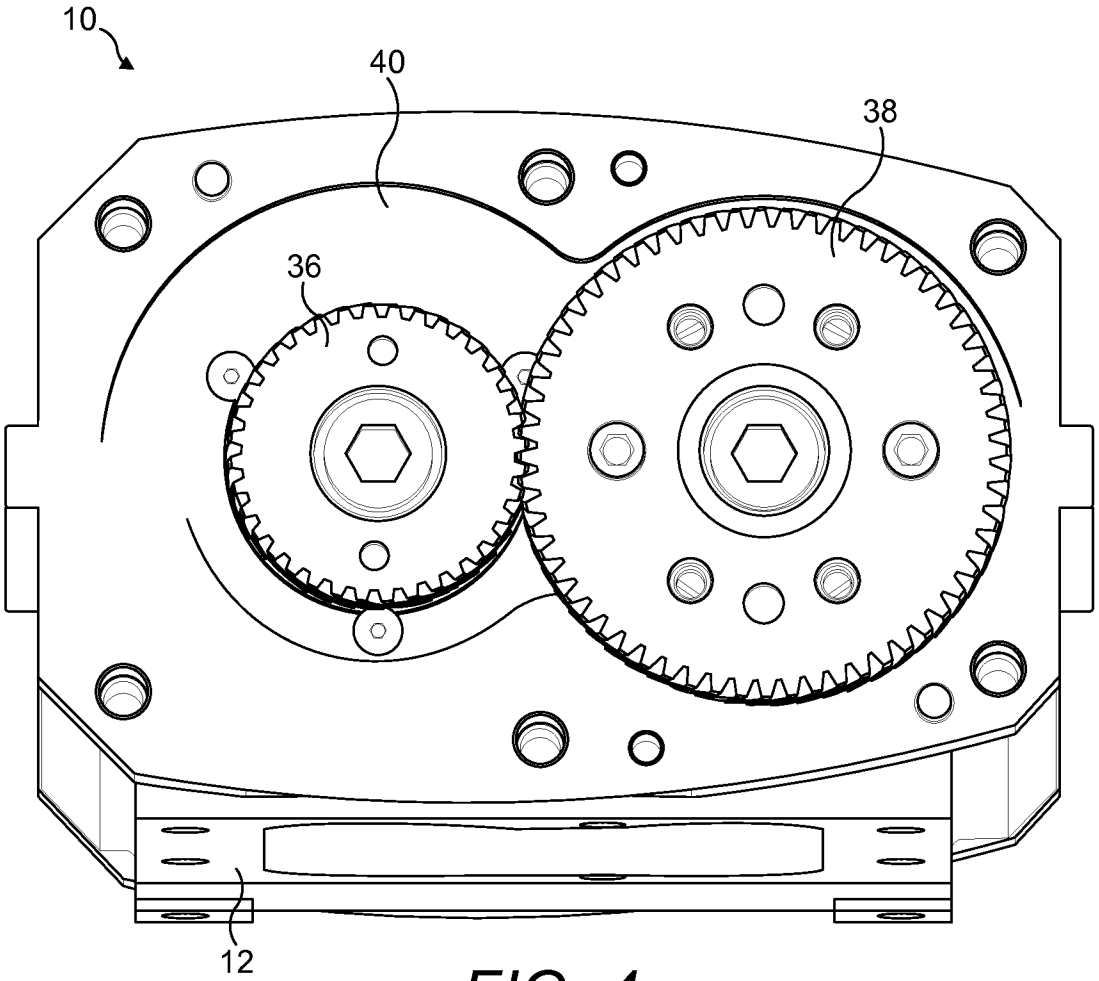
FIG. 4 is a drive end view of the compressor.

With particular reference to FIGS. 2 and 3, the first or female rotor 18 comprises five twisted lobes 42*a*-42*e* (hereinafter referred to in general as "lobes 42"). The second or male rotor 20 is provided with three twisted lobes 44*a*, 44*b* and 44*c* (hereinafter referred to in general as "lobes 44"). Each of the lobes 42 has a leading edge L and a trailing edge T. Respective channels 46 are formed between adjacent lobes 42 in the rotor 18. Each of lobes 44 also have a leading edge L and a trailing edge T with respective channels 47 formed between adjacent lobes 44. In this embodiment the axial distance between leading and trailing edges of the first and second lobes shown as D1 and D2 respectively is different, with D1>D2. This is also reflected in the transverse or radial distance between the edges L and T of each lobe, when measured in the circumferential direction, shown as W1 and W2 in FIGS. 2 and 3 being different with W1>W2.

Each of the rotors 18 and 20 rotates in corresponding bores 48 and 50 formed axially in the housing 12. In this particular embodiment, as the rotors 18 and 20 are of different diameter the bores 48 and 50 are likewise of different diameter. The bores 48 and 50 intersect to form parallel but laterally offset longitudinal ridges 52 and 54.

The general operation of the compressor 10 is as follows. Assuming that drive is imparted to the rotors 18 and 20 so that they are rotating within the housing 12, fluid, typically air, enters housing 12 through inlet 14, which is defined by intake plate 28, filling channels 46 and 47 as rotors 18 and 20 come out of mesh. The air continues to fill channels 46 and 47 which gradually increase in volume as the degree of mesh decreases through the rotor 18 rotating past the ridge 54. The air will fill channels 46 and 47 until the channels reach a maximum volume. Eventually, the channels 46 and 47 rotate to a point where the rotors 18 and 20 eventually commence to mesh. The meshing of the rotors 18 and 20 compresses the air held in the channels 46 and 47. The air is compressed and delivered to the outlet 16 where it may be subsequently used by a further machine such as an internal combustion engine.

Figure 6:
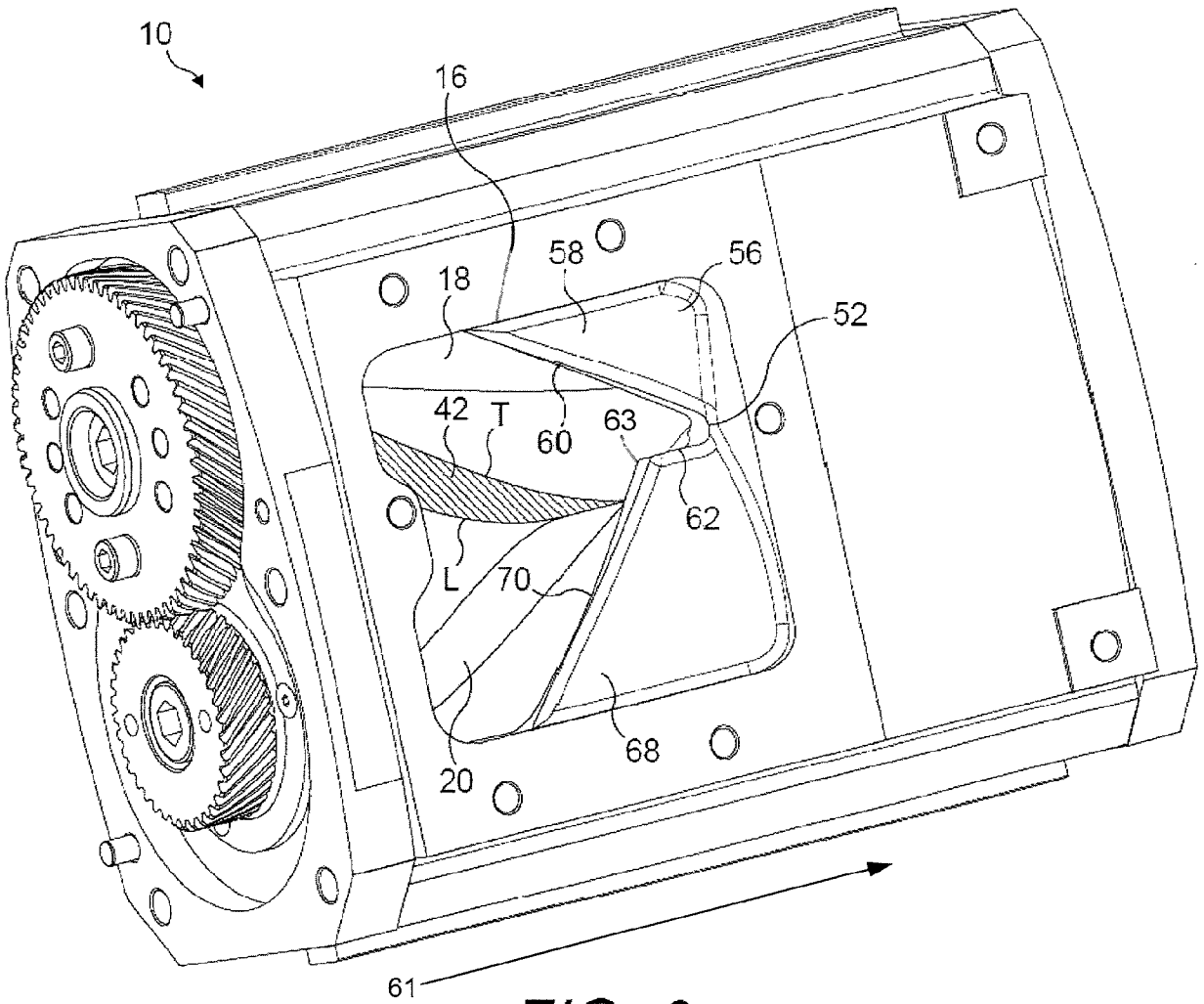
FIG. 6 is a plan view from the bottom of the compressor showing an outlet of the compressor and rotors in a first relative position.
Figure 7:
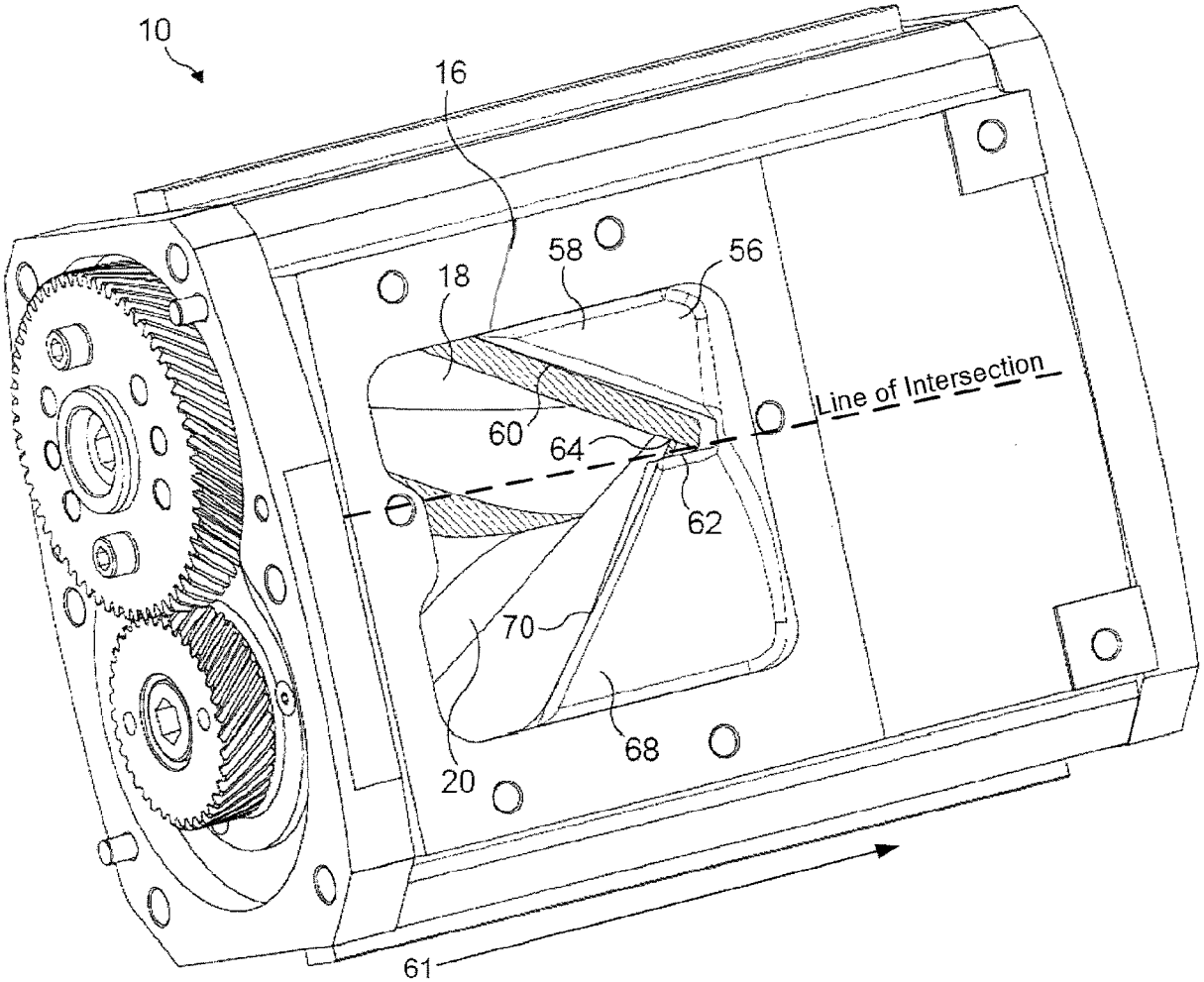
FIG. 7 is a plan view of the compressor showing the outlet where the rotors are in a second configuration rotationally advanced in comparison to FIG. 6.
Figure 8:
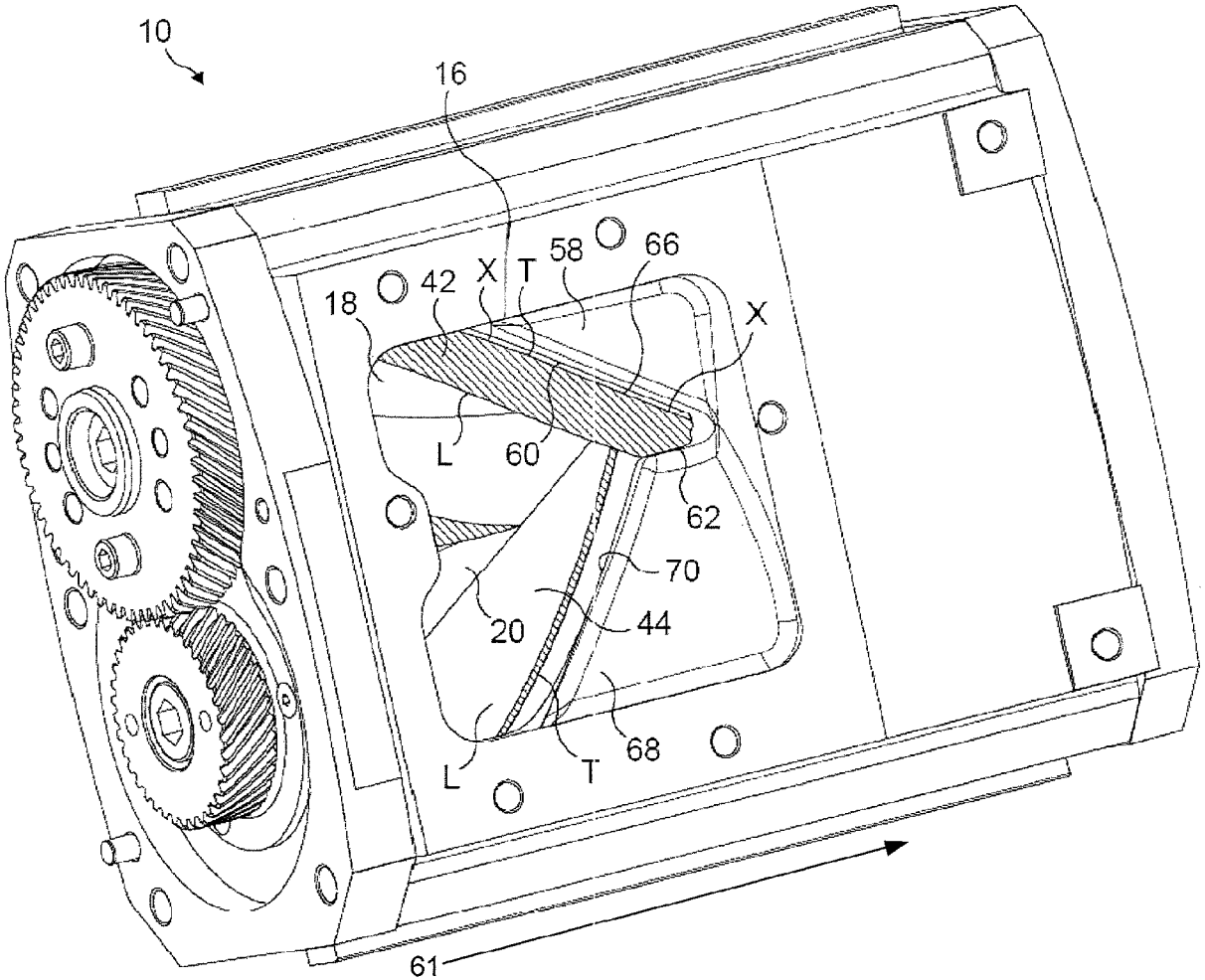
FIG. 8 is a plan view of the outlet of the compressor showing the rotors in a third relative position rotationally advanced in relation to FIG. 7; and, FIG. 9 is a schematic representation of a housing incorporated in an embodiment of the compressor.

With particular reference to FIGS. 6-8, it can be seen that the outlet 16 extends in an axial direction 61 and comprises a wall 56 with a first portion 58 having an edge 60 that is substantially parallel to a length X-X (see FIG. 8) of a lobe 42 of the rotor 18. Typically, air will enter the outlet 16 when the trailing edge T of a lobe 42 is rotated past the edge 60 as shown in FIG. 8. However in this embodiment, the wall 56 of the outlet 16 is also provided with a pressure relief port in the form of a gap 62. The gap 62 in this embodiment is formed contiguously with the wall portion 56. The gap 62 is located in the wall 56 at a position where air being transported by the rotor 18 is able to bleed into the outlet 16 through the gap 62 before the trailing edge T rotates past the edge 60. This is shown sequentially with reference to FIGS. 6-8. In FIG. 6, the gap 62 is substantially closed by virtue of the point of mesh between the rotors 18 and 20 being located inside the housing 12 and behind the wall 56. However, as the rotors continue to rotate, as shown in FIG. 7, the gap 62 opens as the point of mesh 64 is now in advance of the gap 62 and outside of the housing 12. The opening of the gap 62 enables a portion of the air being transported by the rotors to bleed into the outlet 16. This bleeding of air occurs before the trailing edge of T the lobe 42 of rotor 18 passes the edge 60, thus providing a degree of pressure relief to the compressed air.

FIG. 8 shows the rotors, particularly rotor 18, in a rotationally advanced position where the trailing edge T is now past the edge 60 forming an arcuate slot 66 through which air being transported by the rotors can now flow into the outlet 16. Initial tests have indicated that the provision of the gap 62 to enable a bleeding of air into the outlet 16 in advance of full opening of the outlet 16 provides a substantive reduction in outlet temperature with the benefit of providing greater mass of air per unit volume. It is further believed that providing the advanced bleed of air promotes the formation of a discharge vortex in the outlet 16 enabling the air to travel through the outlet 16 along a communication path with lower turbulence and thus greater speed.

Reverting again to FIGS. 6-7, it can be seen that in addition to the wall portion 58, the wall 56 comprises a second wall portion 68 having a corner 63 and an edge 70 that is substantially parallel with a length of a lobe 54 of the rotor 20. The gap 62 opens to allow bleeding of air into the outlet 16 before the trailing edge of either rotor 18 or 20 passes the edge 60 or 70 respectively of the corresponding first and second wall portions 56 and 58.

Also, in this embodiment, the rotors 18 and 20 are rotated at different speeds due to the different ratio gears 36 and 38 and the lobe ratio. This provides the opportunity to construct and operate the compressor 10 with asymmetric timing of the inlet 14 and outlet 16. As the rotor 18 and 20 are rotating at different speeds the induction and exhaust of air can be controlled individually for each rotor. The inlet timing is controlled by configuration of the inlet plate 28, while the outlet timing is controlled by the configuration of the outlet 16.

With particular reference to the outlet timing aspect, this may be effected by configuring the outlet 16 relative to the rotors 18 and 20 so that the trailing edge T of one of the rotors passes the edge of its corresponding wall before the trailing edge of the other rotor passes the edge of its corresponding wall. Thus, with particular reference to FIG. 8, it will be seen that by virtue of the greater distance between the trailing edge T of lobe 54 from the edge 70 in comparison with the distance between trailing edge T of a lobe 42 from the edge 60, that the trailing edge T of the rotor 20 passes the edge 70 before, (ie at a different time to) the trailing edge T of the rotor 18. Thus, while air is able to bleed into the outlet port 16 via the gap 62 before either of the meshing lobes of rotors 18 or 20 pass the edges 60 and 70 respectively, the bulk of the air charge from between the rotors 18 and 20 commences to enter the outlet 16 via the gap between the edge 70 and the rotor 20 before air is able to enter into the outlet 16 from between the rotor 18 and the edge 60. This embodiment provides a method for tuning the compressor 10 by configuring the outlet 16 relative to the rotors 18 and 20 so that the trailing edge of a lobe of one of the rotors passes the outlet before a trailing edge of an intermeshing lobe of the second rotor. Providing the different timing widens the peak volumetric efficiency curve for the compressor 10 albeit at the expense of a slight lowering of the peak volumetric efficiency.

Figure 9:
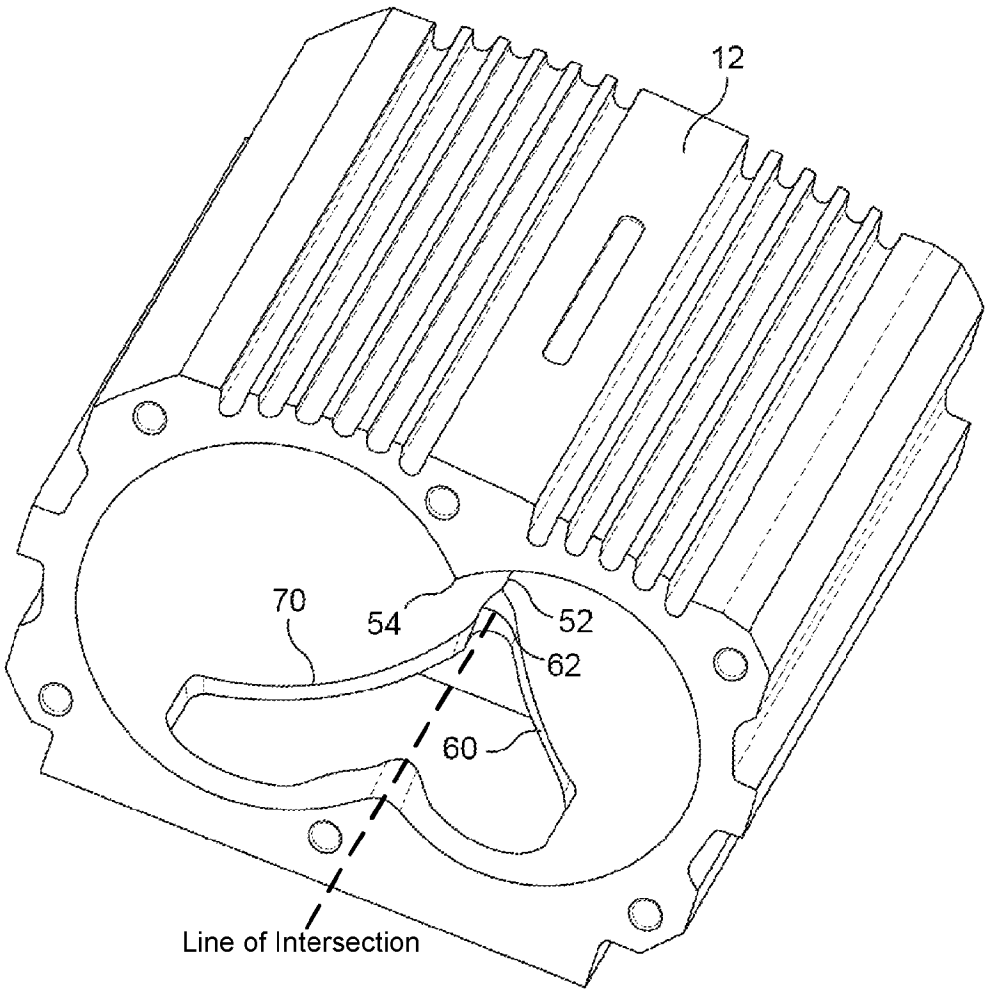

It will be seen from FIG. 9 that the gap 62 projects inwardly into the housing 12 generally along the ridge line 52. The gap 62 may be structured or configured to be offset relative to the ridge 52 so that a greater width or area of the gap 62 lies on one side of the ridge 52 than the other. Changing the offset of the width about the ridge line 52 and varying the length of the gap 62 along the line 52 enables control over the timing of the initially bleeding of air into the outlet 16 as well as the volume of air bled into the outlet 16 through the gap 62 and the bulk pressure of the air bled into the outlet 16. The latter being significant in determining the delta temperature.

Figure 5:
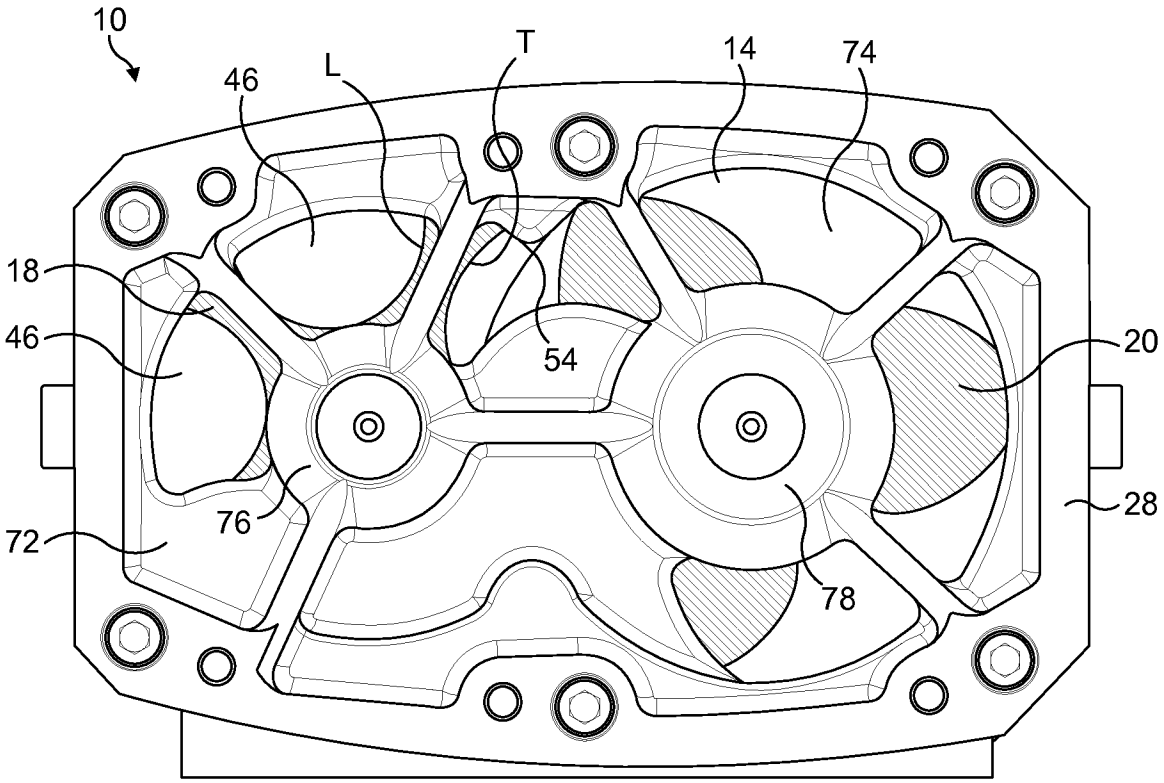
FIG. 5 is a view of an opposite intake end of the compressor.

FIG. 5 illustrates an inlet timing aspect of the compressor 10. The inlet 14 is defined by the inlet plate 28 that is attached (typically by bolting) to one end of the housing 12. The inlet plate is formed with a web 72 which covers an area of the inlet 14 and effectively closes that portion of the inlet. A remaining portion 74 of the inlet plate 28 is open allowing the passage of air or other fluid into the inlet 14. The inlet plate 28, is also provided with respective cups 76 and 78 for seating the studs 82 and 84.

As explained in greater detail below, the structure of the inlet 14 and the particular configuration of the opening 74 and the web 72 facilitate ram charging or in effect an "over filling" of the compressor 10 to potentially increase volumetric efficiency to above 100%. This occurs as follows.

Consider the rotor 18 as it rotates out of mesh with the rotor 20 which commences roughly when the leading edge of a lobe 42 of the rotor 18 rotates past the ridge 54. The channel 46 of that corresponding lobe commences to increase in volume by virtue of the vacating lobe of the rotor 20, creating a relative vacuum. Air is now able to flow into the channel 46 through an inlet end of that channel adjacent the inlet 14. Ata point in the rotation of the rotor 18 the channel 46 will have a maximum volume while remaining in fluid communication through the opening 74 with the inlet. There is a transfer in energy from the rotating rotors (in this instance the rotor 18) to the air being inducted into the channel 46. This energy transfer is imparted as inertia to the air flowing into channel 46 which has the effect of "pulling" an additional volume of air into the channel 46. This also results in a pressure increase of the air in the channel 46 in comparison to inlet air pressure. Thus there is a natural tendency for the additional air to flow back out to the relative low pressure inlet 14. However prior to the air within the channel 46, now at the higher pressure, flowing out of the channel 46, the channel is closed by being rotated past the web 72. Thus, the channel 46 now contains air at a higher pressure than the inlet. Assuming that the air within the now substantially closed channel is at the same temperature as the air at the inlet, the increased pressure necessarily means that there is a greater mass of air within the chamber than would be the case if the air were at the same pressure as the air at the inlet. In this way, the compressor 10 may provide a volumetric efficiency of greater than 100%. Thus in summary this aspect of the inlet timing facilitates the ram charging of a channel 46 (sometimes known as "the spare lobe") for a portion of a revolution of rotor 18 then a substantial sealing of that channel for a second contiguous portion of the revolution of the rotor.

Exactly the same process is occurring with respect to the inlet side of the rotor 20. While the "spare lobe" of the rotor is also closed to trap the additional air volume, this occurs at different time by appropriate configuring of the web 72 due to the different speed of the rotor 20 to the rotor 18.

Embodiments of the invention have been described with reference to a twin rotor supercharger. However embodiments of the present invention may be equally applied to other forms and types of compressors and rotary positive displacement machines. Thus, as would be understood by those skilled in the art, the aspect of the present invention relating to the asymmetric timing of between the first and second rotors can of course only be incorporated in compressors or machines having two or more rotors. While aspects relating the pressure relief port/gap may be incorporated in compressor having single or multiple rotors or blades. Also while embodiment of this invention have been described in relation an automotive application, embodiments of the invention may be applied to other industries and applications, most notably, but not limited to compressor used in refrigeration systems.

Modification and variations of the present invention as would be apparent to those of ordinary skill in the art are deemed to be within the scope of the present invention the nature of which is to be determined from the above description.

The invention claimed is:

1. A compressor comprising:

a housing having:

i. a circumferential wall having a length disposed along a longitudinal axis, the circumferential wall including a first axial end and an opposing second axial end, the first and the second axial ends being disposed along the length of the circumferential wall, the circumferential wall including a boundary and defining an outlet therethrough, the boundary surrounding the outlet and the outlet having a gap associated therewith;

ii. an intake plate located at the first axial end of the circumferential wall, wherein an intake inlet is disposed wholly in the intake plate, and iii. an end plate located at the second axial end of the circumferential wall opposite the first axial end; and a first rotor and a second rotor, each rotor having a plurality of twisted lobes that includes first rotor lobes associated with the first rotor and second rotor lobes associated with the second rotor, separated by adjacent channels, and each rotor having a first end and a second end opposite the first end supported at the intake plate and the end plate, respectively;

wherein both the first and the second rotors are rotatable within the housing with the first rotor lobes of the first rotor and the second rotor lobes of the second rotor configured to intermesh for a portion of a revolution of the first rotor such that rotating of the first and the second rotors transports a fluid from the intake inlet to the outlet;

wherein the intake inlet is configured for fluid flow through the intake inlet into the channels of both the first and the second rotors; and wherein the boundary of the outlet in the circumferential wall includes:

i. a first edge of the circumferential wall including first edge ends and being parallel to a length of one of the first rotor lobes at the outlet when the one of the first rotor lobes is at least disposed adjacent a length of the first edge during operation of the compressor, ii. a second edge of the circumferential wall including second edge ends and being parallel to a length of one of the second rotor lobes at the outlet when the one of the second rotor lobes is at least disposed adjacent a length of the second edge during operation of the compressor, wherein the first edge and the second edge taper in toward each other in a direction from the end plate toward the intake plate and the first edge extends beyond the second edge relative to said direction such that one of the first edge ends is also extended beyond the second edge in said direction so as to be disposed closer to the intake plate than the second edge ends, and wherein the gap is bound on one side by a portion of the first edge that extends beyond the second edge so as to space the portion of the first edge from the second edge, the gap being positioned within the outlet so as to bleed fluid being transported by the first rotor and the second rotor before a trailing edge of one of the first rotor lobes of the first rotor and a corresponding trailing edge of one of the second rotor lobes of the second rotor, respectively, rotate past the first edge and the second edge.

2. The compressor according to claim 1 wherein the boundary of the outlet further comprises:

an axial edge that forms a corner with the second edge and lies parallel to an axis of rotation of the first rotor; and a transverse edge that lies in a plane perpendicular to the axis of rotation of the first rotor and extends between the axial edge and the first edge;

wherein the gap is positioned between the portion of the first edge that extends beyond the second edge, the axial edge, and the transverse edge.

3. The compressor according to claim 1 wherein the housing further comprises:

two intersecting cavities, each cavity housing one of the first rotor and the second rotor, wherein respective ridges are formed in the housing along lines of intersection between the cavities, and wherein the gap is in substantial alignment with one of the ridges.

4. The compressor according to claim 1, wherein the housing further comprises:

two intersecting cavities, each cavity housing one of the first rotor and the second rotor, wherein respective ridges are formed in the housing along lines of intersection between the cavities, wherein the gap is disposed offset from one of the ridges.

5. The compressor according to claim 1 wherein the first rotor and the second rotor, respectively are formed with different outer diameters.

6. The compressor according to claim 1 wherein the first rotor and the second rotor, respectively are formed with a different number of lobes.

7. The compressor according to claim 1, wherein the first edge is juxtaposed relative to the first rotor and the second edge is juxtaposed relative to the second rotor, wherein the trailing edge of a lobe of the first rotor passes the first edge before a trailing edge of an intermeshing lobe of the second rotor rotates past the second edge when the first rotor and the second rotor rotate during operation of the compressor.

8. The compressor according to claim 7 wherein a transverse distance between leading and trailing edges of the lobe of the first rotor is different from a transverse distance between leading and trailing edges of the lobe of the second rotor.

9. A method of tuning a compressor to affect a volumetric efficiency of the compressor by configuring a boundary of an outlet of the compressor, the compressor having a housing comprising a circumferential wall including an axial end, the circumferential wall further including the boundary defining the outlet opening, the compressor further comprising an intake inlet at the axial end, and first and second rotors rotating in the housing and co-operating to transport a fluid from the intake inlet to the outlet opening, the method comprising:

configuring the boundary of the outlet including defining:

i. a first edge of the circumferential wall including first edge ends and being parallel to a length of a lobe of the first rotor at the outlet when said lobe of the first rotor is at least disposed adjacent a length of the first edge during operation of the compressor;

ii. a second edge of the circumferential wall including second edge ends and being parallel to a length a lobe of the second rotor at the outlet when said lobe of the second rotor is at least disposed adjacent the length of the second edge during operation of the compressor, wherein the first edge and the second edge taper in toward each other in a direction from the end plate toward the intake inlet, and the first edge extends beyond the second edge relative to said direction such that one of the first edge ends is also extended beyond the second edge in said direction so as to be disposed closer to the intake plate than the second edge ends;

iii. a gap bound on one side by a portion of the first edge that extends beyond the second edge so as to space the portion of the first edge from the second edge such that when the first rotor and the second rotor rotate during operation of the compressor, a trailing edge of a lobe of the first rotor passes the first edge before a trailing edge of an intermeshing lobe of the second rotor rotates past the second edge.

10. The compressor according to claim 1, wherein each channel of the first rotor and the second rotor has an inlet end adjacent to the intake inlet and respective lobes of the second rotor project into respective channels of the first rotor during revolution of the first rotor, the rotors when rotating co-operate to draw fluid from the intake inlet into the channels, wherein at a point in the revolution of the first rotor, pressure of fluid in a channel exceeds fluid pressure at the intake inlet; and wherein the intake plate comprises a closed portion that covers an area of the inlet, the first rotor and the intake inlet are relatively configured so that for a portion of a revolution of the first rotor an inlet end of the channel is located behind the closed portion and substantially isolated from the fluid at the intake inlet.

* * * * *